US011565852B2

(12) United States Patent
Buck

(10) Patent No.: US 11,565,852 B2
(45) Date of Patent: Jan. 31, 2023

(54) GARBAGE CAN RETAINING CLIP APPARATUS

(71) Applicant: William Buck, McKinney, TX (US)

(72) Inventor: William Buck, McKinney, TX (US)

( * ) Notice: Subject to any disclaimer, the term of this patent is extended or adjusted under 35 U.S.C. 154(b) by 620 days.

(21) Appl. No.: 16/596,929

(22) Filed: Oct. 9, 2019

(65) Prior Publication Data

US 2021/0107736 A1 Apr. 15, 2021

(51) Int. Cl.

| | |
|---|---|
| ***B65F 1/06*** | (2006.01) |
| ***B65F 1/14*** | (2006.01) |
| ***B65D 33/16*** | (2006.01) |

(52) U.S. Cl.

CPC ..... *B65D 33/1616* (2013.01); *B65F 1/06* (2013.01); *B65F 1/1415* (2013.01)

(58) Field of Classification Search

CPC ..... B65D 33/1616; B65D 33/165; B65D 33/1625; B65D 33/1633; B65D 33/1641; B65D 33/1658; B65D 33/1675; B65D 33/24; B65D 33/243; B65D 33/246; B65D 33/2508; B65F 1/1415; B65F 1/04; B65F 1/06–068; B65F 1/14; B65F 2001/061; Y10T 24/44427; Y10T 24/15; Y10T 24/44444; Y10T 24/44778; Y10T 24/44889

See application file for complete search history.

(56) References Cited

U.S. PATENT DOCUMENTS

| | | | | | |
|---|---|---|---|---|---|
| 3,760,463 | A * | 9/1973 | Schneider | B65D 33/1625 | 294/166 |
| 3,852,702 | A * | 12/1974 | Dowling | H01R 4/26 | 24/30.5 R |
| 3,861,003 | A * | 1/1975 | Boden | F16G 11/101 | 24/30.5 R |
| 4,038,726 | A * | 8/1977 | Takabayashi | A44B 11/06 | 24/186 |
| 4,084,299 | A * | 4/1978 | Noda | A41F 3/02 | 24/507 |
| 4,370,778 | A * | 2/1983 | Madsen | A22C 15/006 | 24/30.5 R |

(Continued)

FOREIGN PATENT DOCUMENTS

| | | | | |
|---|---|---|---|---|
| CH | 520025 A * | 3/1972 | | B65D 33/1625 |
| DE | 9107881 U1 * | 6/1991 | | B65F 1/14 |

(Continued)

*Primary Examiner* — J. Gregory Pickett
*Assistant Examiner* — Abigail Elizabeth Guidry

(57) ABSTRACT

A garbage bag retaining clip apparatus for securing garbage bag excess includes a housing having an open front side separated from an open back side, a top side separated from an open bottom side, and a left side separated from a right side defining a housing inside. A bag gate is flexibly coupled within the housing inside. The bag gate is biased to rest in the pinch position. A plurality of parallel retaining ridges is coupled to the housing. Each of the retaining ridges extends vertically from the right side and the left side within the housing inside. A tab is coupled to the housing. The tab proximal end has a hinge extending between the left side and the right side proximal the top side and the back side. The tab moves between a locked position engaged within the retaining ridges and a released position extending behind the housing.

9 Claims, 6 Drawing Sheets

(56) References Cited

U.S. PATENT DOCUMENTS 4,380,103 A * 4/1983 McGrath ..... A63H 27/10 24/562
4,596,397 A * 6/1986 Conti ..... A45F 5/1026 280/DIG. 3
4,742,601 A * 5/1988 Furutsu ..... B65D 33/1675 24/30.5 R
D303,590 S * 9/1989 Pelosi ..... D8/395
4,895,402 A * 1/1990 Tomita ..... G09F 3/0358 292/307 R
4,941,754 A * 7/1990 Murdock ..... B65F 1/14 383/122
5,079,806 A * 1/1992 Allen ..... B65D 33/1675 24/30.5 R
5,085,060 A * 2/1992 Matsushita ..... A44C 1/00 63/14.3
5,170,644 A * 12/1992 Calabro ..... A44C 7/006 24/518
5,222,961 A * 6/1993 Nakao ..... A61B 17/10 606/143
5,301,392 A * 4/1994 Richman ..... B65D 33/1675 24/30.5 R
5,410,782 A * 5/1995 Holyoake ..... F24F 13/0254 52/509
5,611,507 A 3/1997 Smith
5,636,416 A * 6/1997 Anderson ..... B65F 1/06 24/30.5 R
5,645,186 A * 7/1997 Powers ..... B65F 1/06 220/495.11
5,713,108 A * 2/1998 Solomon ..... B65D 33/1675 24/30.5 R
5,735,495 A * 4/1998 Kubota ..... B65B 67/1227 248/316.5
5,852,850 A * 12/1998 Hanten ..... B65D 33/1675 24/30.5 R
5,987,708 A * 11/1999 Newton ..... B65D 33/1625 24/30.5 R
6,012,686 A * 1/2000 Julian ..... B65F 1/06 220/495.08
6,343,409 B1 * 2/2002 McAllister ..... F16B 5/0692 24/536
6,484,365 B1 * 11/2002 Thompson ..... B60J 3/0204 24/3.12
6,484,374 B2 * 11/2002 McAllister ..... F16B 5/0692 24/561
6,641,187 B2 * 11/2003 Hsu ..... B65B 67/125 383/33
6,675,449 B2 1/2004 Wales
6,695,226 B1 * 2/2004 Stern ..... B65D 83/75 24/326
D510,019 S * 9/2005 Davis ..... D34/10
D522,852 S * 6/2006 Nawrocki ..... D8/395
D581,122 S * 11/2008 Dukes ..... D34/10
D606,420 S * 12/2009 Shoji ..... D9/600
D653,941 S * 2/2012 Yasher ..... D8/395
8,678,327 B1 * 3/2014 McMiller ..... B65F 1/06 248/101
D738,188 S * 9/2015 Snider ..... D8/349
9,341,285 B2 * 5/2016 Magno, Jr ..... H02G 3/32
9,587,659 B1 * 3/2017 D'Artell ..... D06F 55/00
10,099,855 B1 * 10/2018 Higgins, II ..... B65F 1/1415
10,287,093 B2 * 5/2019 Rugg ..... B65F 1/065
10,610,449 B1 * 4/2020 Reaux ..... B65D 33/2575
2001/0039699 A1 * 11/2001 McAllister ..... F16B 5/0692 24/536
2002/0108219 A1 * 8/2002 McAllister ..... F16B 5/0692 24/536
2003/0079319 A1 * 5/2003 McAllister ..... F16B 5/0692 24/536
2003/0120216 A1 * 6/2003 Bouphavichith ... A61J 15/0026 604/178
2003/0135959 A1 * 7/2003 Wales ..... A44B 99/00 24/30.5 R
2003/0152296 A1 * 8/2003 Hutter ..... B65D 81/3461 383/100
2003/0161553 A1 * 8/2003 Kasai ..... B65D 33/2508 383/64
2003/0168868 A1 * 9/2003 Bierlein ..... G09F 3/037 292/307 R
2003/0208887 A1 * 11/2003 Lee ..... B42F 1/02 24/546
2007/0220714 A1 * 9/2007 Davidson ..... B65D 33/1641 24/30.5 L
2008/0191103 A1 * 8/2008 Thurgar ..... B65F 1/06 248/101
2008/0197136 A1 * 8/2008 Dukes ..... B65F 1/06 220/495.11
2008/0256759 A1 * 10/2008 Kasbohm ..... B65F 1/06 24/30.5 S
2009/0056081 A1 * 3/2009 Lin ..... B65F 1/06 24/30.5 R
2009/0261106 A1 * 10/2009 Stelmach ..... B65F 1/06 220/495.11
2010/0064487 A1 * 3/2010 Curtis ..... F16B 2/10 24/513
2013/0212844 A1 * 8/2013 Chen ..... F16K 43/00 24/505
2015/0053689 A1 * 2/2015 Chhina ..... B65F 1/068 220/495.1
2017/0341858 A1 * 11/2017 Cramer ..... B65F 1/1426
2017/0362025 A1 12/2017 Nakamura
2019/0161244 A1 * 5/2019 Burns ..... B65D 33/259
2020/0187631 A1 * 6/2020 Wagner ..... A45F 5/02
2021/0380314 A1 * 12/2021 Collis ..... B65D 33/004

FOREIGN PATENT DOCUMENTS

GB 2090628 A * 7/1982 ..... B65D 63/1027
GB 2245639 A * 1/1992 ..... B65D 33/1675
GB 2306556 A * 5/1997 ..... B65D 33/1675
GB 2553841 A * 3/2018 ..... B65F 1/06
WO WO-03022697 A1 * 3/2003 ..... B65D 33/2591
WO WO-2004028914 A1 * 4/2004 ..... B65D 33/25
WO WO2006091999 9/2006
WO WO-2016128963 A1 * 8/2016 ..... B26B 11/00

* cited by examiner

GARBAGE CAN RETAINING CLIP APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to retaining clips and more particularly pertains to a new retaining clip for securing garbage bag excess.

(2) Description of Related Art Including Information Disclosed Under 37 CFR 1.97 and 1.98

The prior art relates to retaining clips.

BRIEF SUMMARY OF THE INVENTION

An embodiment of the disclosure meets the needs presented above by generally comprising a housing having an open front side separated from an open back side, a top side separated from an open bottom side, and a left side separated from a right side defining a housing inside. A bag gate is flexibly coupled to the left side within the housing inside. The bag gate moves between a pinch position extending to adjacent the right side and a lifted position extending to adjacent the top side. The bag gate is biased to rest in the pinch position. A plurality of parallel retaining ridges is coupled to the housing. Each of the retaining ridges extends vertically from the right side and the left side within the housing inside proximal the back side. A tab is coupled to the housing. The tab proximal end has a hinge extending between the left side and the right side proximal the top side and the back side. The tab moves between a locked position engaged within the retaining ridges and a released position extending behind the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
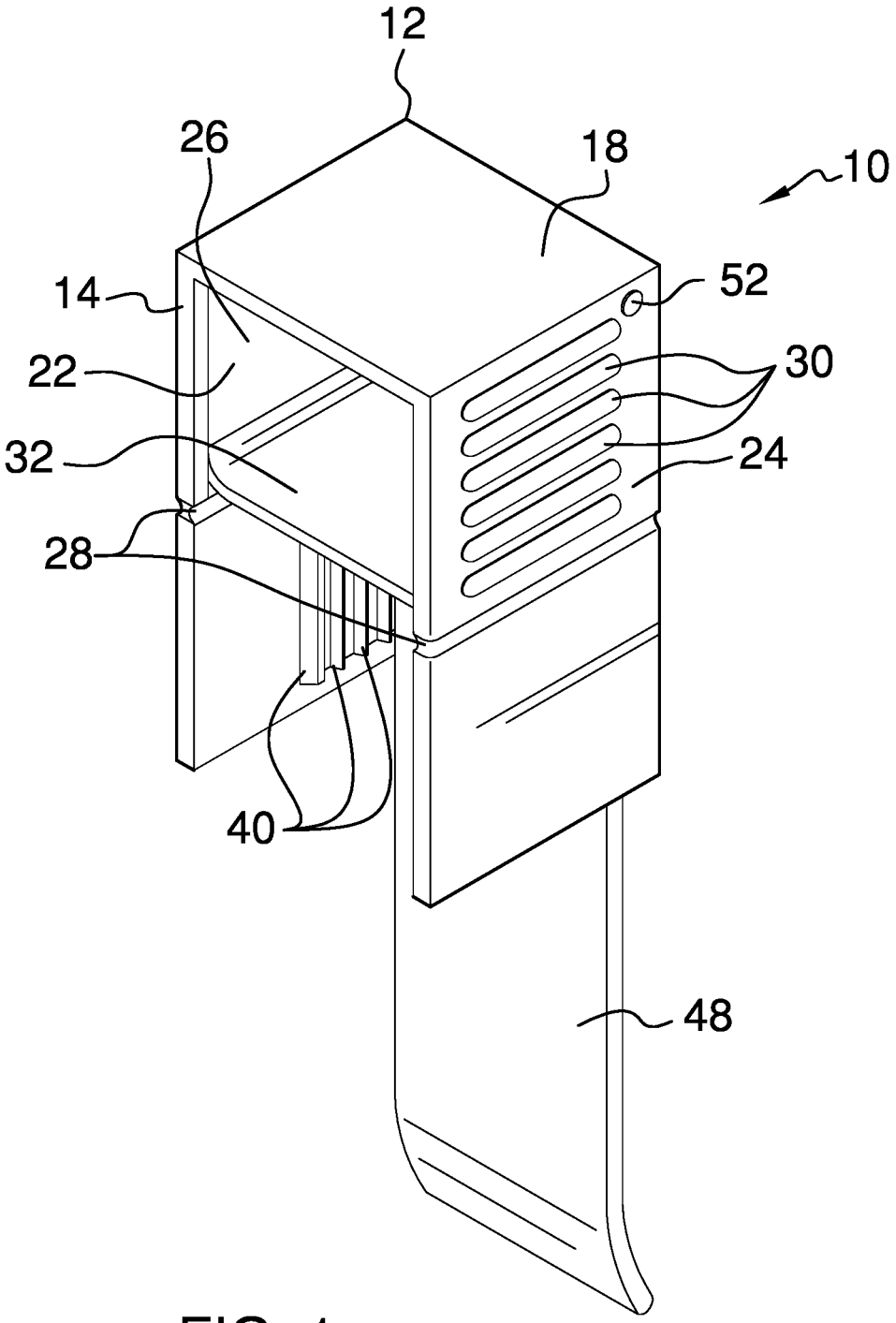
FIG. 1 is an isometric view of a garbage bag retaining clip apparatus according to an embodiment of the disclosure.
Figure 2:
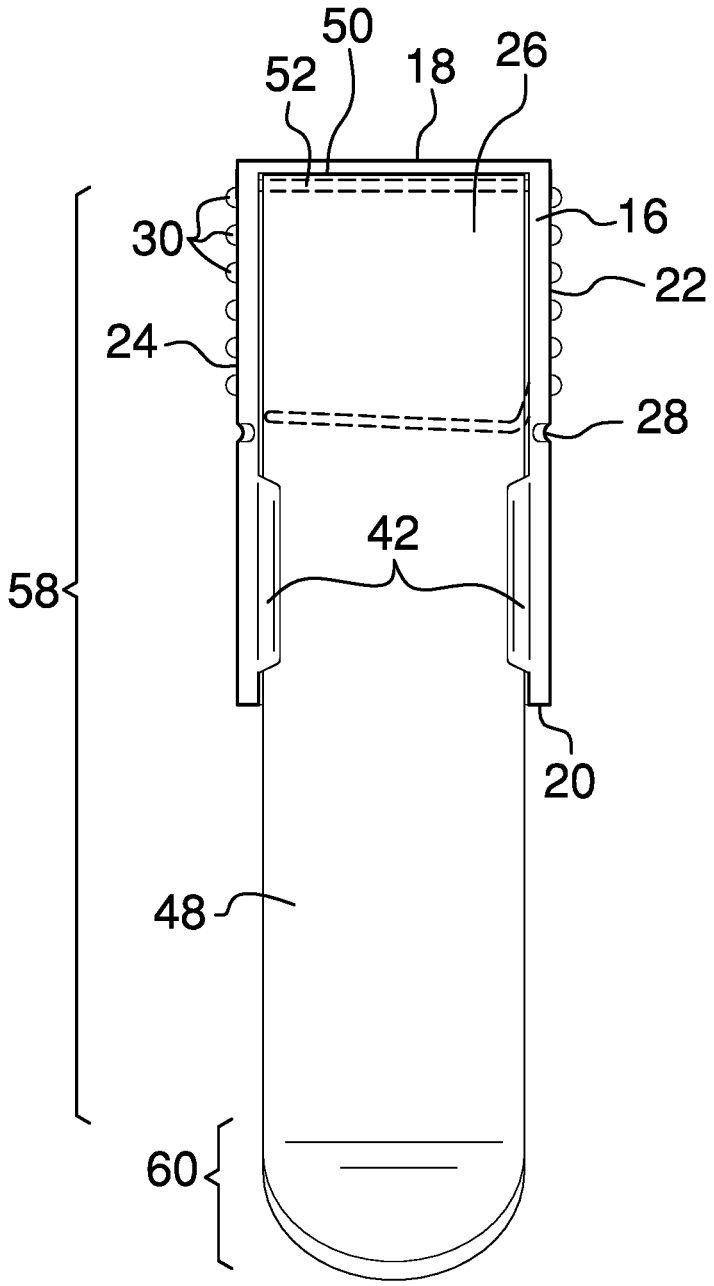
FIG. 2 is a rear elevation view of an embodiment of the disclosure.
Figure 3:
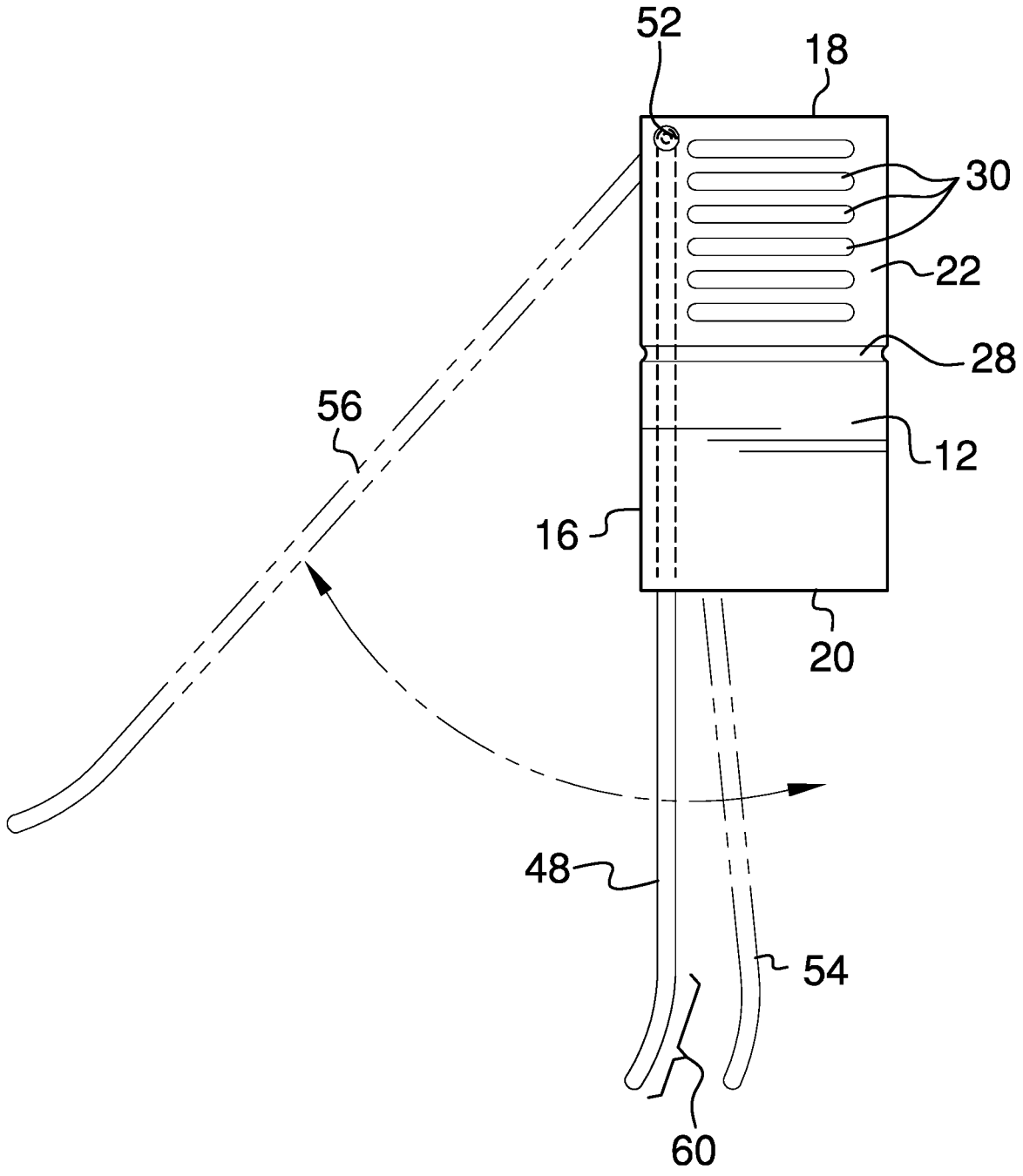
FIG. 3 is a side elevation view of an embodiment of the disclosure.
Figure 4:
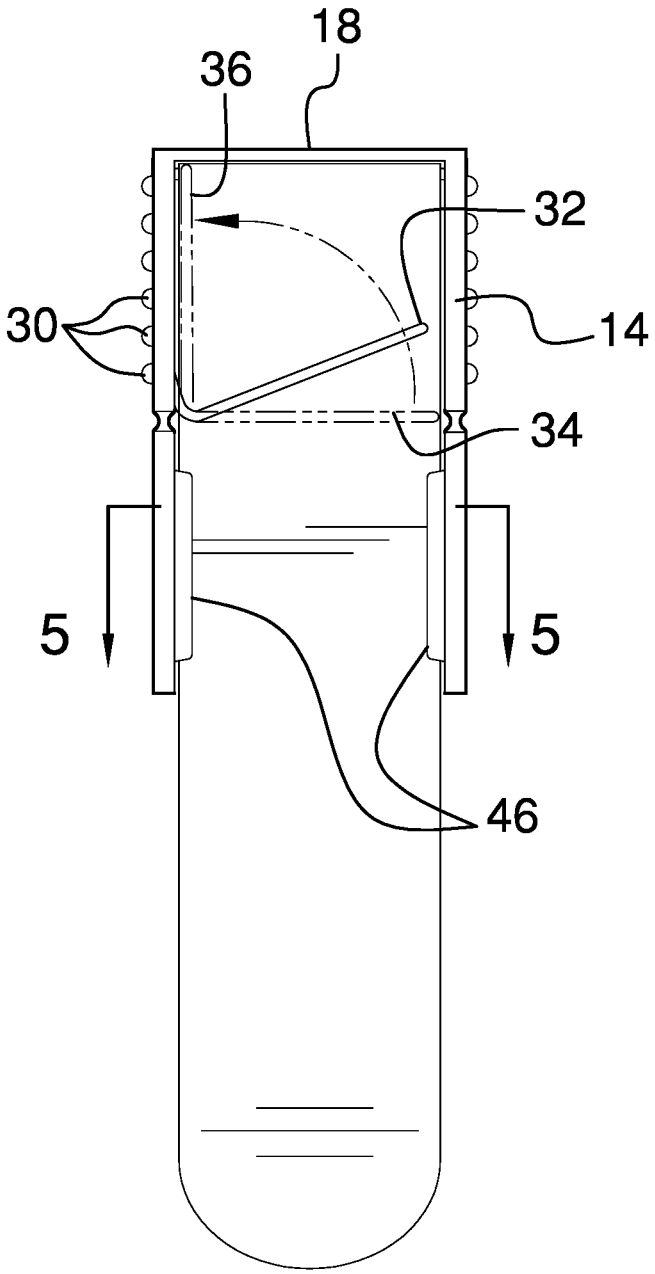
FIG. 4 is a front elevation view of an embodiment of the disclosure.
Figure 5:
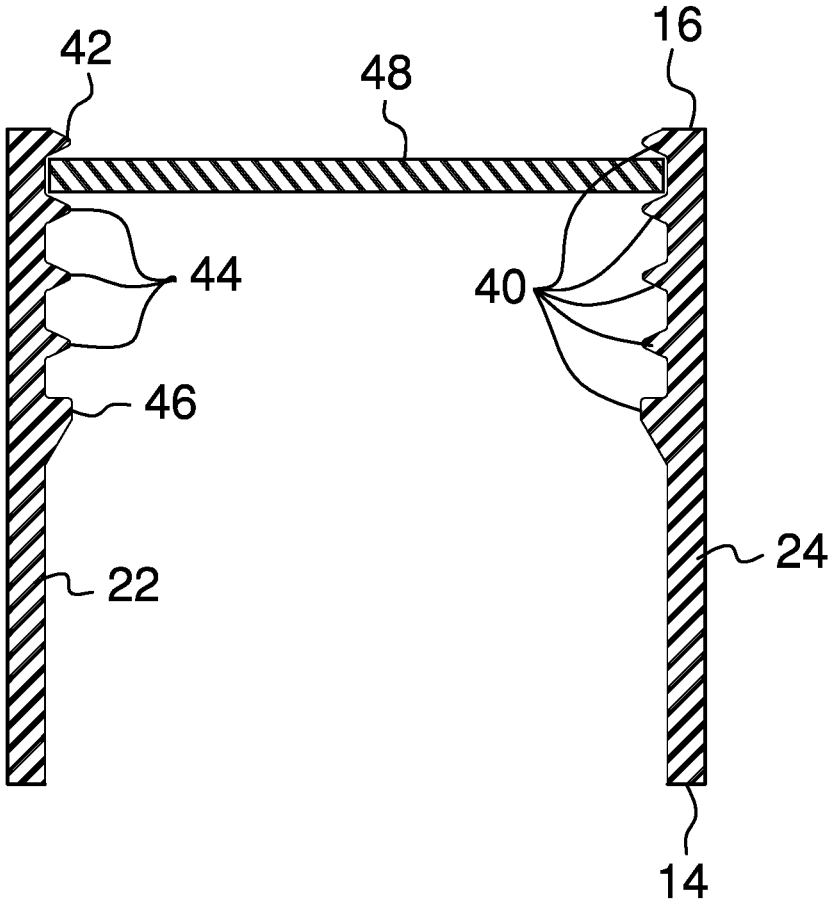
FIG. 5 is a cross-sectional view of an embodiment of the disclosure.
Figure 6:
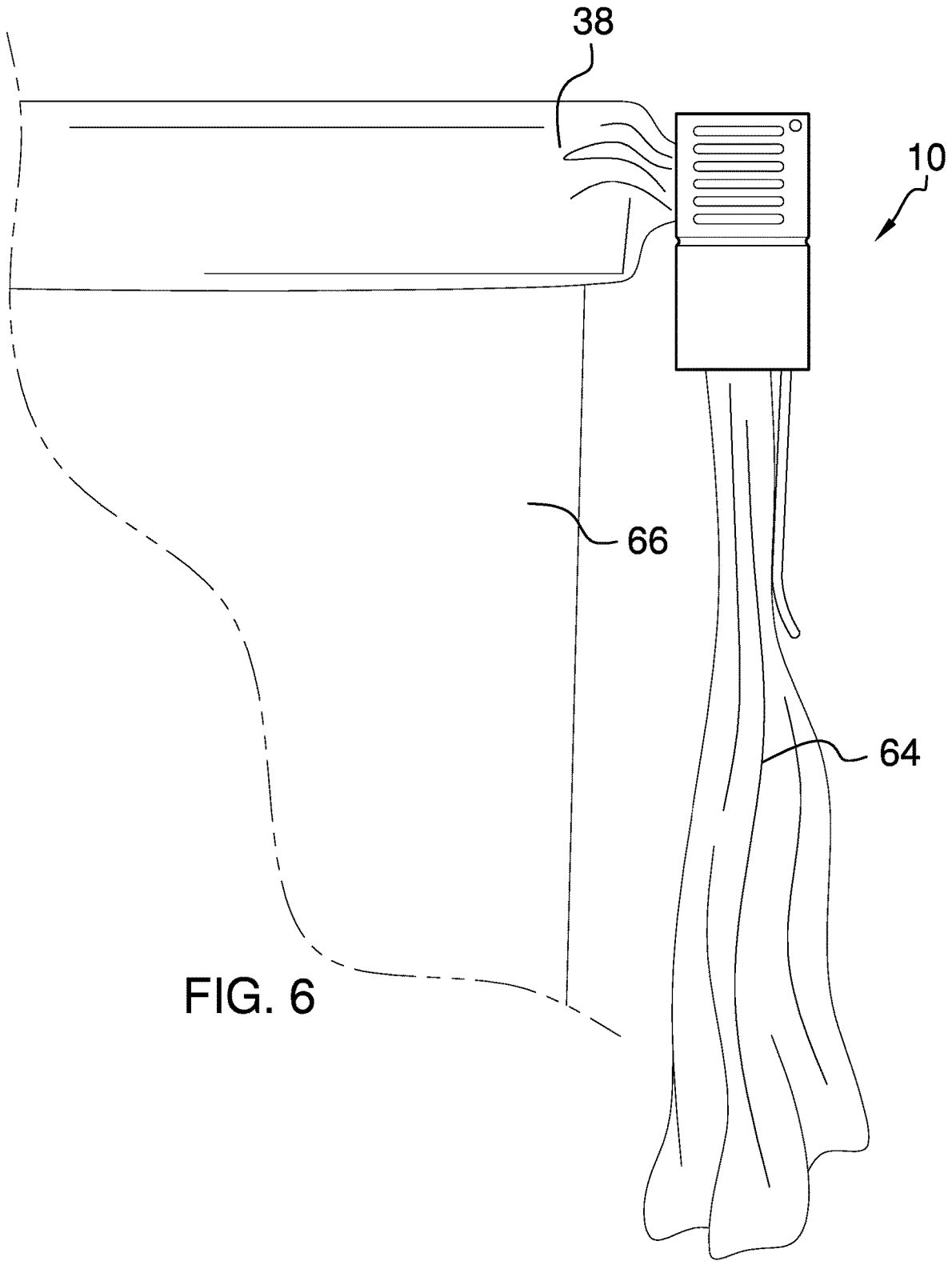
FIG. 6 is an in-use view of an embodiment of the disclosure.

With reference now to the drawings, and in particular to FIGS. 1 through 6 thereof, a new retaining clip embodying the principles and concepts of an embodiment of the disclosure and generally designated by the reference numeral 10 will be described.

As best illustrated in FIGS. 1 through 6, the garbage bag retaining clip apparatus 10 generally comprises a housing 12 having an open front side 14 separated from an open hack side 16, a top side 18 separated from an open bottom side 20, and a left side 22 separated from a right side 24 defining a housing inside 26. Each of the left side 22 and the right side 24 having a horizontal medial groove 28 extending from the front side 14 to the back side 16. A plurality of parallel grip ridges 30 may be coupled to the housing 12 to allow a user to more easily secure the apparatus 10. The grip ridges 30 are coupled to the left side 22 and the right side 24 above the medial groove 28. There may be six grip ridges 30 on each of the left side 22 and the right side 24. A bag gate 32 is flexibly coupled to the left side 22 within the housing inside 26. The bag gate 32 moves between a pinch position 34 extending substantially perpendicularly from the left side 22 to adjacent the right side 24 and a lifted position 36 extending substantially parallel to the left side 22 to adjacent the top side 18. The bag gate 32 is biased to rest in the pinch position 34 and is configured to secure a garbage hag 38 passing through the front side 14 and out the bottom side 20.

A plurality of parallel retaining ridges 40 is coupled to the housing 12. Each of the retaining ridges 40 extends vertically from the right side 24 and the left side 22 within the housing inside 26 proximal the back side 16 and below the medial groove 28. The plurality of retaining ridges 40 may comprise a pair of outermost ridges 42 adjacent the back side 16, a set of three pairs of medial ridges 44, and a pair of innermost ridges 46. Each of the outermost ridges 40 may be trapezoidal. A tab 48 is coupled to the housing 12. The tab 48 has a proximal end 50 having a hinge 52 extending between the left side 22 and the right side 24 proximal the top side 18 and the back side 16. The tab 48 moves between a locked position 54 engaged within the retaining ridges 40 and a released position 56 extending behind the housing 12. The tab 48 has a planar portion 58 extending from the proximal end 50 past the bottom side 20 of the housing and a curved portion 60 extending from the planar portion 58 to a distal end 62. The curved portion 60 may slope away from the housing 12.

In use, an excess portion 64 of the garbage bag is passed through the front side 14 and out the bottom side 20 and pinched in place by the bag gate 32, thus securing the garbage bag 38 tightly on a garbage can 66. To be released the tab 48 is moved to the released position 56 so the bag gate 32 may be moved to the lifted position 36 and the apparatus 10 may be disengaged from the garbage bag 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garbage bag retaining clip apparatus comprising:

a housing, the housing having an open front side separated from an open back side, a top side separated from an open bottom side, and a left side separated from a right side defining a housing inside;

a bag gate coupled to the housing, the bag gate being flexibly coupled to the left side within the housing inside, the bag gate moving between a pinch position extending substantially perpendicularly from the left side to adjacent the right side and a lifted position extending substantially parallel to the left side to adjacent the top side, the bag gate being biased to rest in the pinch position;

a plurality of parallel retaining ridges coupled to the housing, each of the retaining ridges extending vertically from the right side and the left side within the housing inside proximal the open back side; and a tab coupled to the housing, the tab having a proximal end having a hinge extending between the left side and the right side proximal the top side and the open back side, the tab moving between a locked position engaged within the retaining ridges and a released position extending behind the housing.

2. The garbage bag retaining clip apparatus of claim 1 further comprising a plurality of parallel grip ridges coupled to the left side and the right side of the housing.

3. The garbage bag retaining clip apparatus of claim 1 further comprising the tab having a planar portion extending from the proximal end past the open bottom side of the housing and a curved portion extending from the planar portion to a distal end.

4. The garbage bag retaining clip apparatus of claim 3 further comprising the curved portion sloping away from the housing.

5. The garbage bag retaining clip apparatus of claim 1 further comprising the plurality of retaining ridges comprising a pair of outermost ridges adjacent the open back side, a set of three pairs of medial ridges, and a pair of innermost ridges.

6. The garbage bag retaining clip apparatus of claim 5 further comprising each of the outermost ridges being trapezoidal.

7. The garbage bag retaining clip apparatus of claim 2 further comprising each of the left side and the right side having a horizontal medial groove extending from the front side to the open back side.

8. The garbage bag retaining clip apparatus of claim 7 further comprising the plurality of grip ridges being coupled above the medial groove and the plurality of retaining ridges being coupled below the medial groove.

9. A garbage bag retaining clip apparatus comprising:

a housing, the housing having an open front side separated from an open back side, a top side separated from an open bottom side, and a left side separated from a right side defining a housing inside, each of the left side and the right side having a horizontal medial groove extending from the front side to the open back side;

a plurality of parallel grip ridges coupled to the housing, the grip ridges being coupled to the left side and the right side above the medial groove;

a bag gate coupled to the housing, the bag gate being flexibly coupled to the left side within the housing inside, the bag gate moving between a pinch position extending substantially perpendicularly from the left side to adjacent the right side and a lifted position extending substantially parallel to the left side to adjacent the top side, the bag gate being biased to rest in the pinch position;

a plurality of parallel retaining ridges coupled to the housing, each of the retaining ridges extending vertically from the right side and the left side within the housing inside proximal the open back side and below the medial groove, the plurality of retaining ridges comprising a pair of outermost ridges adjacent the open back side, a set of three pairs of medial ridges, and a pair of innermost ridges, each of the outermost ridges being trapezoidal; and a tab coupled to the housing, the tab having a proximal end having a hinge extending between the left side and the right side proximal the top side and the open back side, the tab moving between a locked position engaged within the retaining ridges and a released position extending behind the housing, the tab having a planar portion extending from the proximal end past the open bottom side of the housing and a curved portion extending from the planar portion to a distal end, the curved portion sloping away from the housing.

* * * * *